United States Patent [19]

Hoshi

[11] Patent Number: 4,934,079

[45] Date of Patent: Jun. 19, 1990

[54] DISPLAY PANEL DEVICE

[76] Inventor: Hatsuo Hoshi, No. 13-19, Shikichi 2-chome, Shizuoka-shi, Shizuoka-Ken, Japan

[21] Appl. No.: 241,203

[22] Filed: Sep. 7, 1988

[30] Foreign Application Priority Data

| | | | |
|---|---|---|---|
| Sep. 10, 1987 | [JP] | Japan | 62-138456 |
| Sep. 29, 1987 | [JP] | Japan | 62-148595 |
| Mar. 28, 1988 | [JP] | Japan | 63-40919 |
| Jun. 24, 1988 | [JP] | Japan | 63-83675 |

[51] Int. Cl.[5] ..... A47F 11/06; B44F 1/00; G09F 19/12

[52] U.S. Cl. ..... 40/427; 40/455; 40/463; 40/465; 40/584; 40/902

[58] Field of Search ..... 369/19; 40/541, 455, 40/457, 463, 465, 446, 427, 124.1, 902, 584

[56] References Cited

U.S. PATENT DOCUMENTS 4,670,798 6/1987 Campbell et al. ..... 369/19

FOREIGN PATENT DOCUMENTS 2710876 9/1978 Fed. Rep. of Germany ..... 40/541
83/02029 6/1983 World Int. Prop. O. ..... 40/427

*Primary Examiner*—James R. Brittain
*Assistant Examiner*—J. Hakomaki

[57] ABSTRACT

A display panel device includes a display panel having a sensor sensitive to light, sound, heat and so on and a recorder/playback combination attached thereto. As an object transparent to or shielding light and generating sound or heat approaches the panel, the sensor is automatically actuated to give an automatic actuation to the recorder/playback combination, thereby reproducing music or sound from the surface of the display panel.

2 Claims, 3 Drawing Sheets

DISPLAY PANEL DEVICE

BACKGROUND OF THE INVENTION

1. Field of the Invention

The present invention relates to a display panel device and, more particularly, to a display panel device including a display panel for displaying thereon a poster or photograph or reproducing thereon an image and a recorder/playback combination adapted to be actuated by a sensor to reproduce sound.

2. Statement of the Prior Art

All the photographs and posters heretofore in use are formed of a single flat sheet or panel. For that reason, when it is intended to use them while reproducing music or voices for advertising purposes, a recorder/-playback system or a playback system is attached to them separately from such photographs or posters. Transporting or forwarding of such advertising photographs or posters experiences a grave inconvenience. Practically, only photographs or posters are displayed for advertising purposes, unless otherwise provided for, thus leading to decreased advertising merits.

Recently, dialogue type telephones, interphones and displays for tele-conference have been steadily introduced, but they are not yet widespread among the general public due to their expensiveness.

SUMMARY OF THE INVENTION

An object of the present invention is to obtain a display panel device which adds increased effects to advertisement, and is inexpensive and easy to handle.

Another object of the present invention is to provide a display panel device which is made convenient-to handle by accommodating all the electrical circuits and components used with a recorder/playback combination in a blocked box together therewith, and which is easy to assemble, transport and maintain.

A further object of the present invention is to provide a display panel device which is inexpensive and of a dialogue type, and uses a ccd camera or a mirror(s) to display the image of a customer on an image display portion, while automatically reproducing explanations or advertisements in sound on the goods appearing on a photograph or poster on a display panel, as the customer approaches it.

According to display panel device of the present invention, a sensor of, e.g. about 5 mm×5 mm and sensitive to light, sound, heat and so on and a recorder/-playback combination (or a playback) of 3 mm in thickness and of postcard size are closely fitted together onto a portion of the flat plane of, e.g., a photograph, a poster or the like for easy forwarding and transporting. As someone passes or sound are produced near the photograph or poster, the sensor is automatically actuated by the generation of sound, by the shielding of light or the reception of infra-red rays or sound to make electrical connection is effected to the recorder/playback combination or the playback, so that the recorder/playback combination or the playback is automatically actuated to generate music or sound, as if the photograph or poster generated. The recorder/playback combination or the playback can also be made thin, small and inexpensive by the use of an IC memory, unlike conventional recorded playback combination or the playback in which ordinary tapes are used. Thus, the recorder/-playback combination or the playback can be closely fitted onto photographs, posters and so on, so that their tranporting and forwarding are easily carried out, adding very much increased effects on advertisement. The on-off switch may be substituted for the sensor. If the sensors are made integral with the recorder/playback combination or the playback, then it is possible to obtain more increased efficiency and make handling much easier.

According to the present invention, the means for generating sounds or music directly from photographs and so on includes a photograph mount formed of a paper-like material or a platic material such as foamed styrol or blow molded articles, each of about 5 mm in thickness, in which a extra-miniature and extra-thin playback of name card size and an on-off switch or a sensor sensitive to sound, light, heat and so on are incorporated together. Using as a sound generating source an IC memory chip in which sounds or music have previously been recorded by an external ROM writer permits free selection of sounds or music. Thus, the playback can find wider applications.

The playback is automatically actuated by the actuation of the on-off switch or the sensor sensitive to sound, light, heat and so on to reproduce a sound message to the outside. The display panel device of the present invention is as light as 50 g or less in its total weight, and is thus inexpensive. To use this display panel device, users only need to put photographs thereon, since the playback is entirely embedded in the photograph mount.

According to the present invention, a flat sheet-like display panel of about 10 to 20 mm in thickness and formed of paperboard or a light plastic material such as foamed styrol is further framed with a metal or a non-ferrous metal (such as an aluminium sheet). As the sensor, the display panel is provided on a lower portion of its front surface with a sensor the focal length and direction of which are determined by a combination of a flannel type lens with a focusing IR sensor. The recorder/playback combination is received in a blocked box formed in a lower portion of the back surface of the display panel.

Since a microphone, change-over switch, recording indicator (LED), volume and cells for recording/storing and power source employed with the recorder/-playback combination must be constantly used or replaced, they may be exposed on the display panel or lidded.

First, the power source switch is put on to record as a digital signal a sound message in the memory through the microphone. As someone approaches the required position, the focusing IR sensor is automatically actuated to operate the recorder/playback combination, thereby reproducing the sound message from the front surface of the display panel to the outside through a speaker, since the flannel type lens and the focusing IR sensor, both arranged on the front surface of the display panel, have been predetermined in terms of their focal length and direction.

In place of the power source cell, use may be made of an AC adapter.

According to the present invention, the display panel is further provided on its upper portion with a ccd camera, which serves to display a customer coming before the display panel on an image display portion. At that time, the focusing IR sensor or a cds sensor disposed on a lower portion of the display panel automatically energizes the associated electrical circuitry, and senses an approaching customer to automatically reproduce the explanations or advertising messages previously recorded in the recorder/playback combination integrally incorporated in the display panel.

Detailed Description of the Preferred Embodiments

Figure 1:
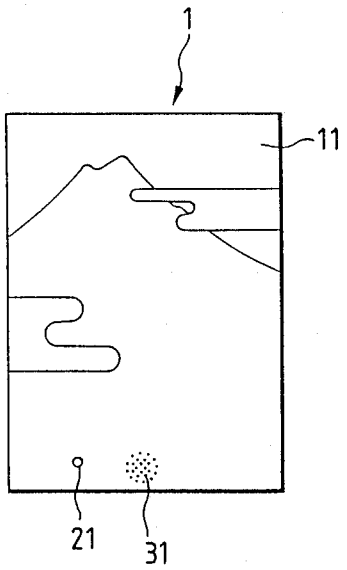
FIG. 1 is a plan view of the front side of a first embodiment of the diaplay panel according to the present invention.
Figure 2:
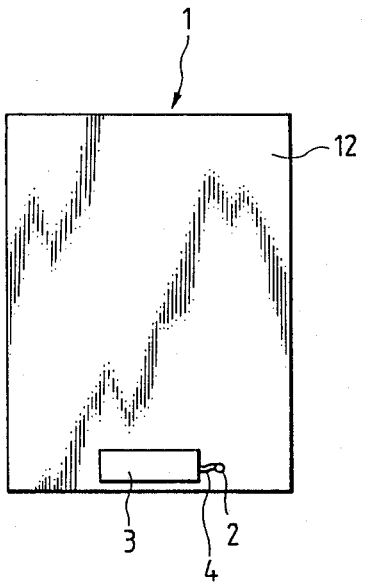
FIG. 2 is a plan view of the back side of the first embodiment.
Figure 3:
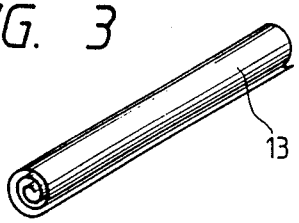
FIG. 3 is a perspective view of the first embodiment, which is rolled up for the purpose of transportion.

Referring now to FIGS. 1 to 3, the first embodiment of the display panel device according to the present invention is explained, wherein a display panel 1 is defined by, e.g., a photograph or poster etc. per se. FIG. 1 shows a front side 11 of the panel 1, FIG. 2 illustrates a back side 12 thereof, and FIG. 3 is a perspective view of the panel 1 in a rolled-up state.

The panel 1 is provided on its back side 12 with a sensor 2 and a recorder-playback combination (or a playback) 3, which are connected with each other by means of a conductor 4.

The panel 1 is provided in its front side 11 with a hole 21 for the sensor 2 and a hole 31 for the recorder/-playback 3.

As a man or other object approaches the panel 1, the sensor 2 is automatically actuated to send to the recorder/playback 3 a signal by which it is automatically actuated to reproduce the music previously recored therein.

Preferably, the sensor 2 includes a functional portion sensitive to heat, light, sound waves, currents, magnetism and so on.

As will be appreciated from the embodiments to be described later, the display panel 1 is formed of a material having a suitable thickness, which is selected from paper, plastics, wood, metals and non-ferrous metals.

As illustrated in FIG. 3, the panel 1 may be rolled up for storage or tranportation.

Figure 4:
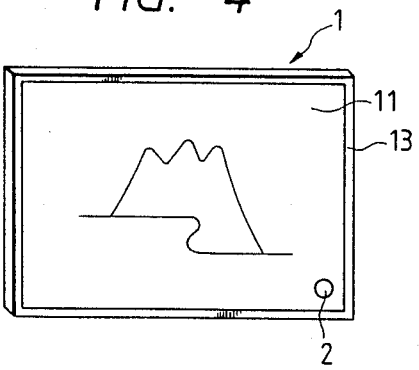
FIG. 4 is a perspective view of the front side of a second embodiment of the display panel according to the present invention.

The second embodiment of the display panel 1 according to the present invention will now be explained with reference to FIGS. 4 through 6. FIG. 4 shows a front side 11 of the display panel 1, FIG. 5 illustrates a back side 12 thereof, and FIG. 6 shows a circuitry diagram.

In the second embodiment, the display panel 1 is a photograph mount formed of, e.g., paperboard, foamed styrol or blow molded articles and framed at 13 with plastics, metals or non-ferrous metals by way of example.

Figure 5:
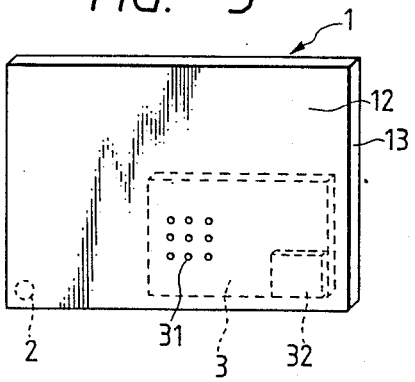
FIG. 5 is a perspective view of the back side of the second embodiment.

As illustrated in FIG. 5, the display panel 1 is mounted on its lower portion with an on-off switch or sensor 2 and a recorder/playback combination 3 (only a playback in the instant embodiment). The recorder/-playback 3 is provided with speaker holes 31, and cell 32 is received therein.

Figure 6:
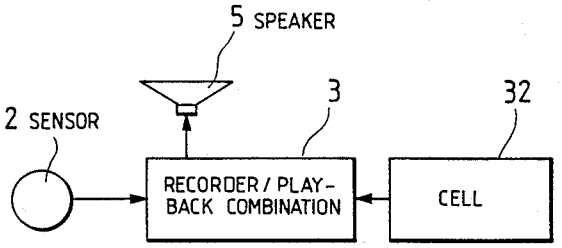
FIG. 6 is a circuitry diagram of the second embodiment.

As illustrated in FIG. 6, the recorder/playback 3 is connected with the on-off switch or sensor 2, the cell 32 and a speaker 5 to define a reproduction circuit.

As the sensor 2 senses a man or any other object, the playback 3 is actuated to reproduce the sound or music stored in an IC memory chip from the speaker 5 through the holes 31.

The cell 32 is the power source required to actuate the playback 3. Used to this end is usually a small and lightweight cell such as lithium, silver oxide and mercury cells by way of example. The cell 32 is received in a box provided in the panel 1 for easy attachment or detachment from outside.

In order to put the second embodiment to practical use, users only need to apply a photograph on the display panel. The display panel of this embodiment may very conveniently be cut to a postcard size, stamped and sent to a desired place.

Only with an ROM writer previously placed in photo studios or other shops, users can freely record the desired sounds or music in an IC memory chip as the means for sending sounds or music making use of the playback.

Figure 7:
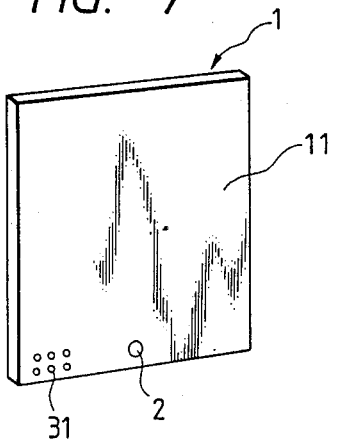
FIG. 7 is a perspective view of the front side of a third embodiment of the display panel according to the present invention.
Figure 8:
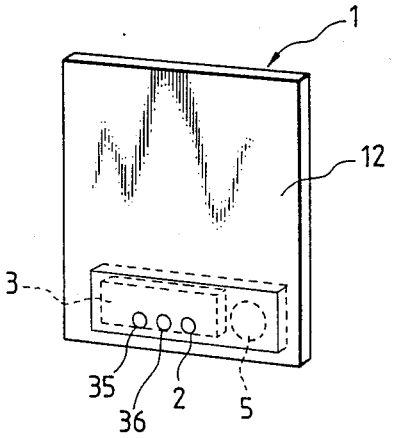
FIG. 8 is a perspective of the back side of the third embodiment.

The third embodiment of the display panel device according to the present invention will now be explained with reference to FIGS. 7 through 9. FIG. 7 shows a front side 11 of a display panel 1, FIG. 8 illustrates a back side thereof, and FIG. 9 is a circuitry diagram.

In the third embodiment, the display panel 1 is defined by a poster panel, and a sensor 2 is of the focusing IR type.

Figure 9:
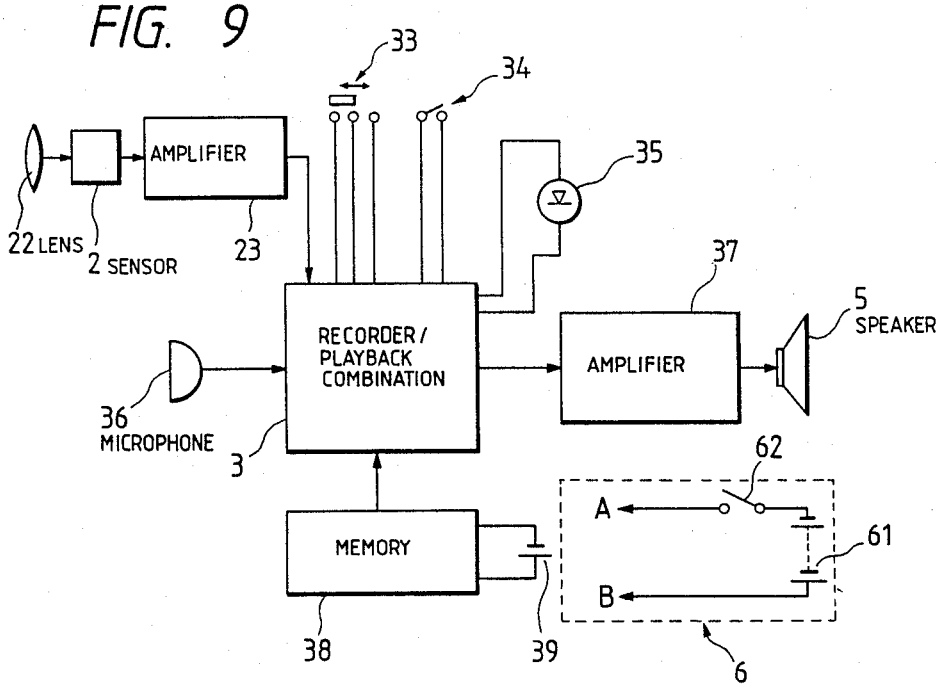
FIG. 9 is a circuitry diagram of a recorder/playback combination used with the third embodiment.

As illustrated in FIG. 9, light beams focused by a lens 22 are guided to the sensor 2, amplified at an amplifier 23, and fed to a recorder/playback combination 3 as a detection signal. The recorder/playback combination 3 meets both the recording and playback functions.

Arranged in connection with the recorder/playback 3 are a slide switch 33, a start switch 34, a recording mode indicator 35, a microphone 36, an amplifier 37, a speaker 5, a memory 38 and a power source box 6.

The power source box 6 accommodates a cell 61 and a switch 62, and all the electrical circuit blocks are electrically connected together, as shown by arrows A and B, by putting on the switch 62. As the start switch 34 is put on and the slide switch 33 is slid left into a recording mode, as shown by an arrow, to input a sound message by the microphone 36, the sound message can be recorded in the memory 38 in the form of a digital signal. At that time, the recording mode indicator (LED) 35 is lit up. A cell 39 for recording is used to record the sound message over an extended period of time.

As the slide switch 16 is then slid right as shown by an arrow, the focusing IR sensor 2 is automatically actuated upon someone approaching the required position, since the focal length and direction are determined by a combination of a flannel type lens 22 with the focusing IR sensor 2, and a signal is fed to the recorder/playback 3 through the amplifier 23 to convert the message digitally recored in the memory 38 to a sound which is in turn reproduced from the speaker 5 to outside.

The recorder/playback 3 is defined in an electrical block including a sound synthesizer LSI, and permits different messages to be automatically reproduced, since several phrases can be recorded. An automatic operation (by means of remote controls making use of, e.g., sound waves, electrical waves, heat rays or light) or a manual operation or operations (making use of a keyboard) is also possible.

Figure 10:
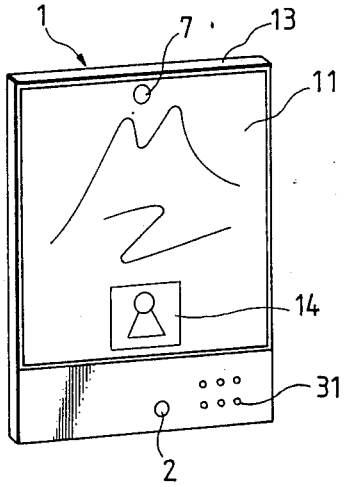
FIG. 10 is a perspective view of the front side of a fourth embodiment of the display panel according to the present invention.
Figure 11:
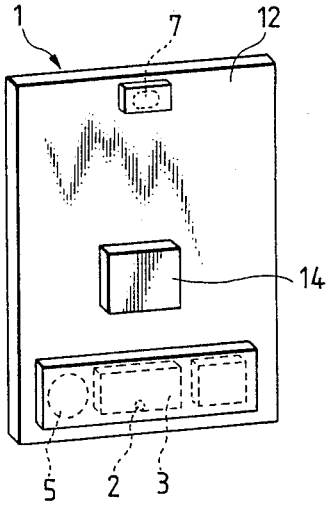
FIG. 11 is a perspective view of the back side of the fourth embodiment.
Figure 12:
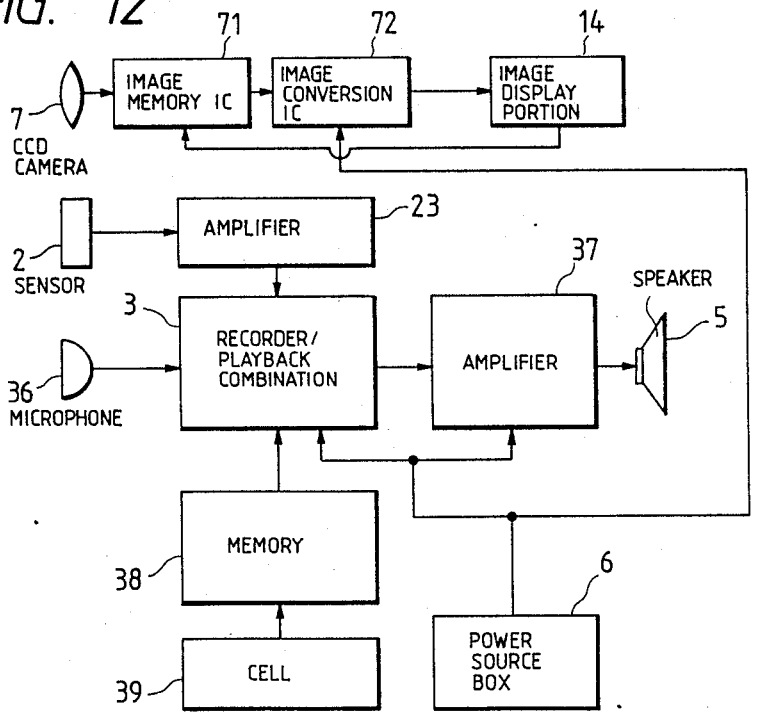
FIG. 12 is a circuitry diagram of a recorder/playback combination used with the fourth embodiment.

The fourth embodiment of the display panel device according to the present invention will now be explained with reference to FIGS. 10 through 12. FIG. 10 shows a front side 11 of a display panel 1, FIG. 11 is a back side thereof, and FIG. 12 is a circuitry diagram.

In the fourth embodiment, the display panel 1 is defined by a poster panel, and a sensor 2 is of the focusing IR type. Further, a ccd camera 7 is attached to an upper portion of the panel 1, and an image display portion 14 is provided at a suitable position of the panel 1 to display thereon a man or any other object approaching the panel 1.

In place of the ccd camera, use may be made of a mirror plate or mirror plates.

The image of customers are sensed by the ccd camera 7 disposed on the display panel 1, which is subsequently sent to the image memory IC 71 for conversion by the image conversion IC 72, and the converted image are displayed on the image display portion 14 and, at the same time, the focusing IR sensor 2 senses approaching customers to automatically actuate the recorder/playback 3, so that advertising messages or explanations on the poster are automatically reproduced in sound from the speaker 5.

Other structures are substantially identical with those explained in connection with FIG. 9.

I claim:

1. A display panel device comprising: a display panel for displaying thereon a photograph or poster; light-detecting sensor means mounted on said display panel; recording and playback means mounted on said display panel and actuated by said light-detecting sensor for recording a preselected audio message and playing said message upon activation by said light-detecting sensor means; speaker means operably coupled to said recording and playback means; a power source for said recorder and playback means mounted on said display panel; and a variable-angle ccd camera detachably mounted on said display panel, with at least one portion of said display panel being adapted to display visual output of said ccd camera.

2. The display panel of claim 1 wherein said display panel is comprised of a material selected from the group consisting of paper, plastics, wood, and ferrous and non-ferrous metals.

* * * * *